US007377753B2

(12) United States Patent
Kuroda

(10) Patent No.: US 7,377,753 B2
(45) Date of Patent: May 27, 2008

(54) FUEL SUPPLY PUMP

(75) Inventor: Akihiro Kuroda, Anjo (JP)

(73) Assignee: Denso Corporation, Kariya, Aichi-pref. (JP)

( * ) Notice: Subject to any disclaimer, the term of this patent is extended or adjusted under 35 U.S.C. 154(b) by 851 days.

(21) Appl. No.: 10/815,950

(22) Filed: Apr. 2, 2004

(65) Prior Publication Data

US 2004/0197216 A1 Oct. 7, 2004

(30) Foreign Application Priority Data

Apr. 3, 2003 (JP) ..... 2003-100851
Feb. 16, 2004 (JP) ..... 2004-037839

(51) Int. Cl.
*F04B 19/00* (2006.01)

(52) U.S. Cl. ..... 417/251; 417/313

(58) Field of Classification Search ..... 417/251, 417/252, 440, 441, 313; 123/446; 184/6.4, 184/6.5, 6.8
See application file for complete search history.

(56) References Cited

U.S. PATENT DOCUMENTS

| | | | | |
|---|---|---|---|---|
| 6,113,361 | A | 9/2000 | Djordjevic | |
| 6,142,747 | A | 11/2000 | Rosenau et al. | |
| 6,615,799 | B2 * | 9/2003 | Mori et al. | 123/450 |
| 6,722,864 | B2 * | 4/2004 | Suzuki et al. | 417/470 |
| 6,895,936 | B2 * | 5/2005 | Kuroda | 123/446 |
| 7,207,319 | B2 * | 4/2007 | Utsumi | 123/446 |
| 7,314,351 | B2 * | 1/2008 | Kuroda | 417/251 |
| 2002/0040704 | A1 | 4/2002 | Onishi et al. | |
| 2002/0189438 | A1 | 12/2002 | Furuta | |
| 2003/0101970 | A1 * | 6/2003 | Utsumi | 123/495 |
| 2003/0108443 | A1 * | 6/2003 | Suzuki et al. | 417/470 |
| 2004/0179950 | A1 * | 9/2004 | Kuroda | 417/244 |
| 2004/0197216 | A1 * | 10/2004 | Kuroda | 417/470 |
| 2004/0208753 | A1 * | 10/2004 | Mori | 417/244 |
| 2004/0247469 | A1 * | 12/2004 | Fassbender et al. | 417/441 |
| 2006/0169251 | A1 * | 8/2006 | Mori et al. | 123/446 |

FOREIGN PATENT DOCUMENTS

| | | | |
|---|---|---|---|
| DE | 198 29 217 | A1 | 1/1999 |
| DE | 197 42 180 | A1 | 3/1999 |
| DE | 199 43 160 | A1 | 3/2000 |
| DE | 199 41 689 | A1 | 3/2001 |
| EP | 1022458 | A2 | 7/2000 |
| EP | 1241349 | A2 | 9/2002 |
| GB | 1042259 | | 9/1966 |
| JP | 11-315767 | | 11/1999 |
| JP | 2002-322968 | A | 11/2002 |
| JP | 2003-21023 | A | 1/2003 |

OTHER PUBLICATIONS

Japanese Office Action mailed Jul. 17, 2007 in Application No. 2004-037839 together with an English translation.

* cited by examiner

*Primary Examiner*—Devon C. Kramer
*Assistant Examiner*—Vikansha Dwivedi
(74) *Attorney, Agent, or Firm*—Nixon & Vanderhye P.C.

(57) ABSTRACT

In a fuel supply pump, a fuel relief path relieves a part of fuel, which is supplied through a part of fuel supply path connected between a control valve and a compressing chamber of a pump element, into a slidably contact portion between a plunger of the pump element and a plunger driving unit.

2 Claims, 5 Drawing Sheets

FUEL SUPPLY PUMP

BACKGROUND OF THE INVENTION

The present invention relates to a fuel supply pump of an internal combustion engine.

A common-rail fuel injection system is applied for internal combustion engines such as diesel engine and other similar engines.

The common-rail fuel injection system is equipped with a common rail that accumulates high-pressure fuel and a fuel supply pump that supplies the high-pressure fuel to the common rail. In response to a command from an engine control unit (ECU), the high-pressure fuel in the common rail is injected and supplied through a fuel injection valve to each cylinder of the internal combustion engine at a predetermined period.

An example of conventional fuel supply pumps is disclosed in Japanese Patent Publication H11-315767.

A fuel supply pump 100, as shown in FIG. 5, is provided with a low-pressure feed pump 101 and a pump element. The pump element is composed of a cylinder 109, a plunger 102 contained in the cylinder to be reciprocable in the axial direction, and a compressing chamber 106 formed among inner peripheral surfaces of one end portion of the cylinder 109 and one end surface of the plunger 102.

The fuel supply pump 100 is also provided with a plunger driving unit including a driving shaft 103, a cam 110 mechanically connected to the driving shaft 103 and to the plunger 102, and a pump-cam chamber 111 in which a part of the driving shaft 103 and the cam 110 are contained.

The driving shaft 103 is rotated so that the cam 110 converts the rotation of the driving shaft 103 to reciprocation, and transfers the reciprocation to the plunger 102, whereby the plunger 102 reciprocally moves in the axial direction in the cylinder 109.

The fuel supply pump 100 is further provided with a control valve 107, a check valve 104, a lubricating path 105, and a fuel tank 118.

The fuel accumulated in the fuel tank 118 is supplied by the pump operation of the low-pressure feed pump 101 through the fuel supply path 108 to the compressing chamber 106. The fuel in the compressing chamber 106 is compressed by the reciprocation of the plunger 102 by the plunger-driving unit to be highly pressurized, so that the high-pressurized fuel is supplied to a common rain (not shown).

In addition, a part of the fuel delivered from the low-pressure feed pump 101 is supplied through the lubricating path 105 to the pump-cam chamber 111 so that the slide portions of the pump element are cooled and lubricated.

A fuel flow path connected between the outlet of the low-pressure feed pump 101 and the cylinder 109 to be communicated with the compressing chamber 106 is provided with the control valve 107. The control valve 107 is operative to control the flow rate of the fuel supplied from the low-pressure pump 101 to the compressing chamber 106, thereby controlling the fuel amount supplied to the common rail. This fuel-amount control operation is carried out in response to a command from the ECU to keep the fuel pressure in the common rail at a predetermined pressure. A fuel supply path 108 connected between the control valve 107 and the cylinder 109 to be communicated with the compressing chamber 106 is provided with the check valve 104 that prevents the high-pressurized fuel from flowing backward from the compressing chamber 106 to the control valve 107.

In the conventional configuration of the fuel supply pump 100, even when the ECU sends a command to the control valve 107 to decrease the fuel amount supplied to the common rail, excessive fuel may pass through the control valve 107 into the fuel supply path 108. This overflow is caused by the leakage of fuel from the valve portion of the control valve 107 and/or the delay in the closing of the valve member thereof.

This excessive fuel may be supplied through the fuel supply path 108 to the compressing chamber 106.

Then, in order to relieve the excessive fuel in the fuel supply path 108, a fuel relief path 112 is branched from the fuel supply path 108 to bypass the pump element, and connected to the inlet of the low-pressure feed pump 101.

However, the control valve 107 and the inlet of the low-pressure pump 101 are far from each other, so that the fuel relief path 112 increases in length. In addition, as shown in FIG. 5, because the fuel relief path 112 bypasses the feed pump 101, the fuel relief path 112 is bent at its many mid-points, which causes the form of the fuel relief path 112 to be complicated. This results in deteriorating the workability of fuel relief path 112.

SUMMARY OF THE INVENTION

The present invention is made on the background.

Accordingly, it is an object of the present invention to provide a fuel supply pump, which allows the workability of a fuel relief path for relieving excessive fuel in a fuel supply path to be simplified.

According to one aspect of the present invention, there is provided a fuel supply pump for pressurizing a fuel fed from a low-pressure feed pump, the fuel supply pump comprising: a pump element having a plunger and a compressing chamber, the compressing chamber being connected through a fuel supply path to the low-pressure feed pump, the fuel fed from the low-pressure feed pump being supplied to the compressing chamber through the fuel supply path, the plunger pressurizing the fuel supplied to the compressing chamber; a plunger driving unit having a driving member and a housing for reciprocating the plunger, the driving member being rotatably supported to the housing and slidably contacted to the plunger; a control member provided in the fuel supply path to control a fuel rate of the fuel fed from the low-pressure pump through the fuel supply path; a check valve provided in a part of the fuel supply path, the par of the fuel supply path being connected between the control member and the compressing chamber, the check valve preventing the fuel supplied to the compressing chamber from flowing backward to the control member; lubricating means for supplying a part of fuel to a slidably contact portion between the plunger and the plunger driving unit, the part of fuel being fed from the low-pressure feed pump through the fuel supply path; and fuel relief means for relieving a part of fuel to the slidably contact portion between the plunger and the plunger driving unit, the part of fuel being supplied through the part of the fuel supply path to the compressing chamber.

According to another aspect of the present invention, there is provided a fuel supply pump for pressurizing a fuel fed from a low-pressure feed pump, the fuel supply pump comprising: a pump element having a plunger and a compressing chamber, the compressing chamber being connected through a fuel supply path to the low-pressure feed pump, the fuel fed from the low-pressure feed pump being supplied to the compressing chamber through the fuel supply path, the plunger pressurizing the fuel supplied to the compressing chamber; a plunger driving unit having a driving member and a housing for reciprocating the plunger, the driving member being rotatably supported to the housing and slidably contacted to the plunger; a control member provided in the fuel supply path to control a fuel rate of the fuel fed from the low-pressure pump through the fuel supply path; a check valve provided in a part of the fuel supply path, the par of the fuel supply path being connected between the control member and the compressing chamber, the check valve preventing the fuel supplied to the compressing chamber from flowing backward to the control member; lubricating means for supplying a part of fuel to a slidably contact portion between the plunger and the plunger driving unit, the part of fuel being fed from the low-pressure feed pump through the fuel supply path; first throttle means provided in the lubricating means for controlling the part of fuel supplied through the lubricating means; and fuel relief means for relieving a part of fuel into a downstream side of the lubricating means with respect to the first throttle means, the part of fuel being supplied through the fuel supply means to the compressing chamber.

BRIEF DESCRIPTION OF THE DRAWINGS

Other objects and aspects of the invention will become apparent from the following description of an embodiment with reference to the accompanying drawings in which.

DETAILED DESCRIPTION OF EMBODIMENTS OF THE INVENTION

Embodiments of the invention will be described hereinafter with reference to the accompanying drawings.

First Embodiment

Figure 1:
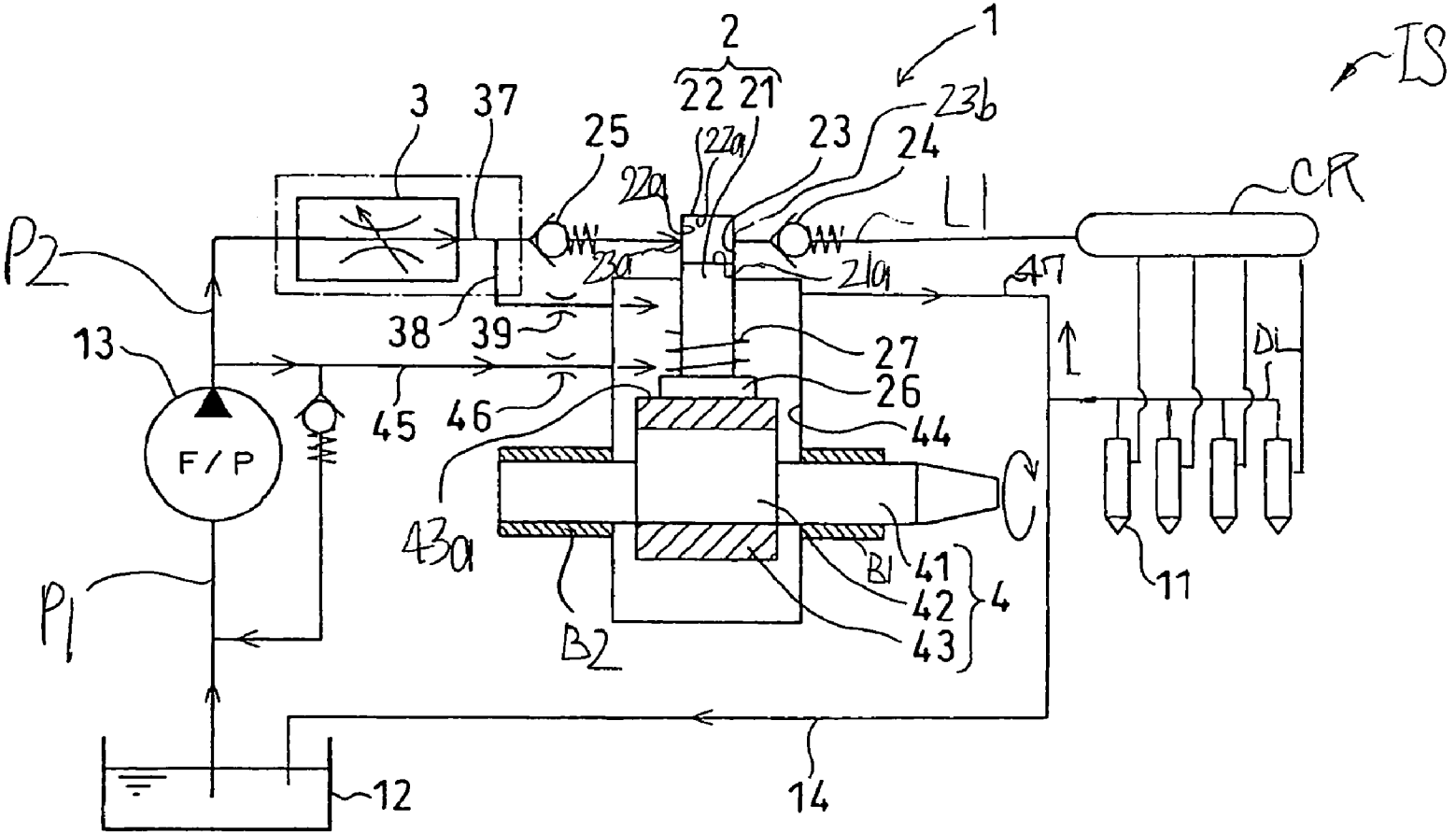
FIG. 1 is a view schematically illustrating the structure of a fuel supply pump according to a first embodiment of the present invention.

As shown in FIG. 1, a fuel supply pump 1, referred to simply as "supply pump" hereinafter, is applied to, for example, a common-rail fuel injection system IS of an internal combustion engine, such as diesel engine. The common-rail fuel injection system IS has a common rail CR for accumulating high-pressure fuel therein, and a plurality of electromagnetic fuel injectors 11 . . . 11 communicated with the common rail CR, respectively.

The common-rail fuel injection system is configured that, in response to a command from an ECU (not shown), the high-pressure fuel in the common rail CR is injected by each of the injectors 11, and the injected high-pressure fuel is supplied to each cylinder of the internal combustion engine at a predetermined period.

The supply pump 1, as shown in FIG. 1, constitutes the common-rail fuel injection system IS, and is served as a high-pressure supply pump for highly pressurizing the fuel in a fuel tank 12 to supply the high-pressurized fuel to the common rail CR.

That is, the supply pump 1 is composed of a pump element 2 configured to highly pressurize the fuel to supply the highly pressurized fuel to the common rail CR, and a control valve 3 for controlling the flow rate of the fuel supplied to the pump element 2.

The supply pump 1 is also composed of a low-pressure feed pump 13 with an inlet and an outlet, which is referred to simply as "feed pump", The inlet of the feed pump 13 is connected to a fuel supply path P1, and the fuel supply path P1 is connected to an inside of the fuel tank 12 to be communicated therewith. The outlet of the feed pump 13 is connected to a fuel supply path P2, and the fuel supply path P2 is connected to the pump element 2. The control valve 3 is provided in the fuel supply path P2.

The feed pump 13 is configured to pump the fuel from the fuel tank 12 through the fuel path P1 and supply the pumped fuel through the fuel path P2 and the control valve 3 to the pump element 2.

Incidentally, the feed pump 13 may be integrally fit to the supply pump 1, or may be separately provided to either the fuel tank 12 or a fuel path from the fuel tank 12 to the control valve 3. The feed pump 13 may be rotatably driven by the internal combustion engine, another electrical motor, or a hydraulic actuator.

The pump element 2 is composed of a plunger 21, a cylinder 22 in which the plunger 21 is contained to be reciprocable in the axial direction, and a compressing chamber 23 formed among inner peripheral surfaces 22*a* of one end portion of the cylinder 22 and one end surface 21*a* of the plunger 21. The fuel supply path P2 is communicated with the inlet 23*a* of the compressing chamber 23.

The fuel accumulated in the fuel tank 12 is pumped by the pump operation of the feed pump 13 through the fuel supply path P1, and the pumped fuel is supplied through the fuel supply path P2 and the control valve 3 to the compressing chamber 23. The fuel in the compressing chamber 23 is compressed by the reciprocation of the plunger 21 to be highly pressurized, so that the high-pressurized fuel is outputted from the outlet 23*b* of the compressing chamber 23 to an output line L1. In the output line L1, a check valve 24 is provided so that the high-pressurized fuel is supplied through the check valve 24 to the common rail CR. The check valve 24 prevents the high-pressurized fuel from flowing backward to the compressing chamber 23.

In addition, a check valve 25 is provided in the fuel supply path P2 between the inlet 23*b* of the compressing chamber 23 and the control valve 3. The check valve 25 prevents the highly pressurized fuel from flowing backward from the compressing chamber 23 to the control valve 3.

The supply pump 1 is also composed of a plunger driving unit 4 mechanically connected to the plunger 21 for driving the plunger 21 so that the plunger 21 reciprocates in the axial direction in the cylinder 23. The plunger 21 is provided at its other end portion, which is opposite to the compressing chamber side, with a plunger head 26. The plunger head 26 has a slide surface slidably contacted to a slide surface of the plunger driving unit 4. The plunger head 26 is biased by a spring 27 so that the slide surface of the plunger head 26 is contacted to the slide surface of the plunger driving unit 4.

The plunger driving unit 4 is provided with a driving shaft 41, a cam 42, and a cam ring 43. The driving shaft 41 is rotatably supported around its axial direction by bearings B1 and B2, mechanically connected to a crank shaft (not shown) of the internal combustion engine so that the driving shaft 41 is rotatably driven by the rotation of the crank shaft of the internal combustion engine. The cam 42 is eccentrically attached to the driving shaft 41 so that the cam 42 revolves around the driving shaft 41 by the rotation thereof.

The cam ring 43 contains the cam 42 through a metal bush so that the cam ring 43 revolves around the driving shaft 41 by the rotation of the driving shaft 41. The cam ring 43 has an outer peripheral surface 43*a* corresponding to the slide surface of the plunger driving unit 4.

The revolution of the cam ring 43 and the force applied by the spring 27 to the plunger head 26 make the plunger 21 reciprocate in the cylinder 23 in the axial direction. Simultaneously, the plunger head 26 reciprocates on the outer peripheral surface 43*a* (slide surface) of the cam ring 43 relative to the cam ring 43.

That is, the rotation of the drive shaft 41 rotatably driven by the internal combustion engine is converted by the cam 42 to the reciprocation, and the reciprocation is transferred to the plunger 21.

The plunger driving unit 4 is also composed of a pump-cam chamber 44 in which a part of the driving shaft 41, the cam 42, and the cam ring 43 are contained.

The supply pump 1 is also provided with a lubricating path 45 that is branched from the fuel supply path P1 and communicated with the pump-cam chamber 44. A part of the fuel exhausted from the feed pump 13 is supplied through the lubricating path 45 to the pump-cam chamber 44. The part of the fuel allows the slide portions of the cam ring 43 and the plunger head 26, those of the metal bush and the cam 42, and the bearings B1 and B2 of the driving shaft 41 to be cooled and lubricated, respectively. A throttle 46 is provided in the lubricating path 45 so that it controls the flow rate of the fuel supplied to the pump-cam chamber 44.

The supply pump 1 is also composed of an overflow path 47 connected to the pump-cam chamber 44 to be communicated therewith. The overflow path 47 is connected to a common drain line DL of the injectors 11 and to a fuel reflux path 14 communicated with the fuel tank 12. The part of fuel used as the slide portion lubricant flows through the overflow path 47 into the reflux path 14, and excessive fuel returned from the injectors 11 through the drain line DL also flow into the reflux path 14. The part of the fuel and the excessive fuel flow together through the reflux path 14 and are returned into the fuel tank 12.

On the other hand, the control valve 3 is operative to control the flow rate of the fuel supplied from the feed pump 13 through the fuel supply path P2 to the compressing chamber 23. This fuel-rate control operation of the control valve 3 is carried out so that the control valve 3 controls the valve opening of its valve member in response to a command from the ECU to keep the fuel pressure in the common rail CR at a predetermined pressure. The control valve 3, therefore, allows the amount of the high-pressurized fuel supplied to the common rail CR to be controlled.

Figure 2A:
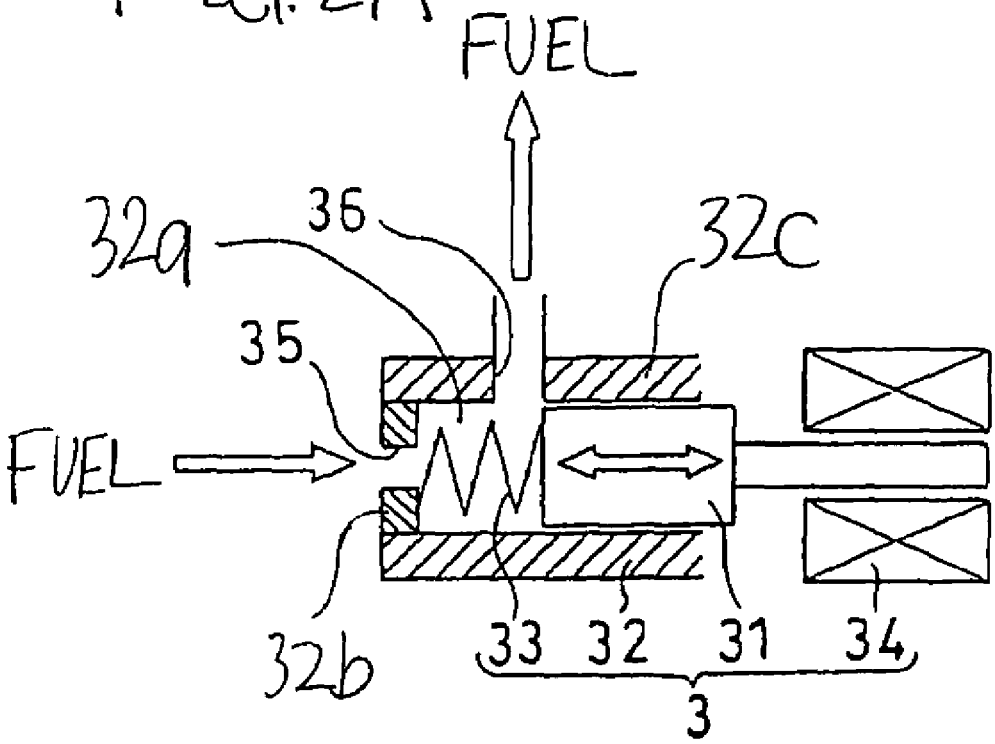
FIG. 2A is a sectional view illustrating the structure of a control valve, shown in FIG. 1, whose needle performs opening operation according to the first embodiment.
Figure 2B:
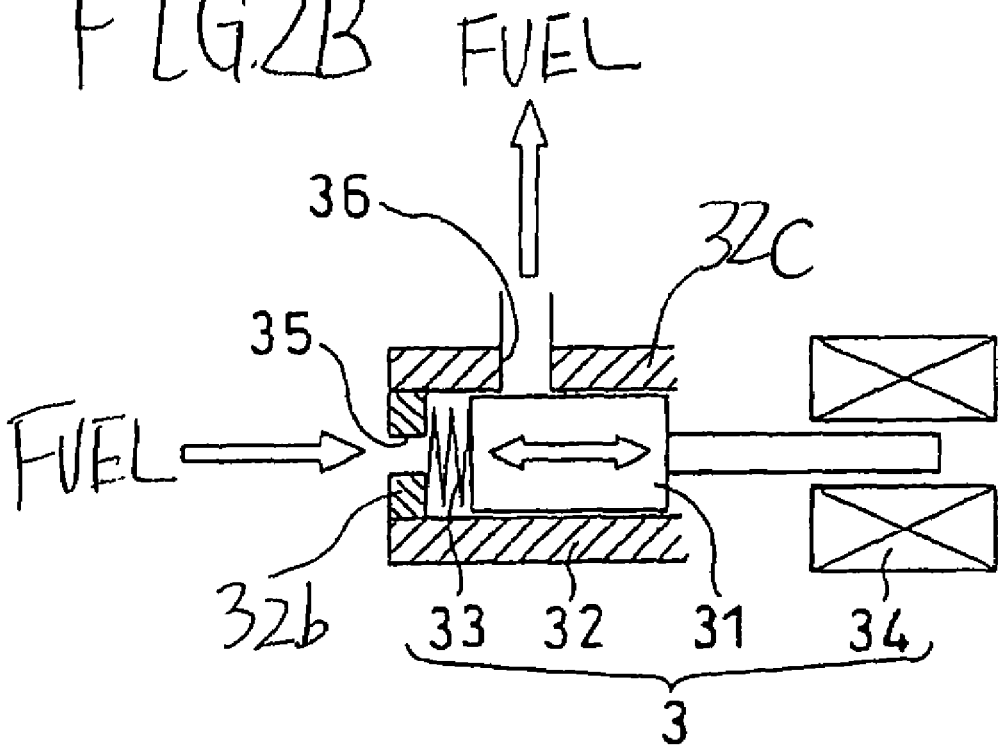
FIG. 2B is a sectional view illustrating the structure of the control valve, shown in FIG. 2A, whose needle performs closing operation according to the first embodiment.

In particular, the control valve 3, as shown in FIGS. 2A and 2B, is provided with a needle 31 as the valve member, and a tubular housing 32 having an inner chamber 32*a* in which the needle 31 is contained. The housing 32 has at its one end wall 32*b* with a suction port 35 formed therethrough. The suction port 35 is connected to the fuel supply path P1 so that the fuel supplied from the feed pump 13 is sucked through the suction port 35 into the inner chamber 32*a*. The housing 32 also has at its peripheral side wall 32*c* a discharge port 36 connected through the fuel supply path P2 to the compressing chamber 23.

The control valve 3 is also provided with a spring 33 contained in the inner chamber 32*a* and interposed between the one end wall 32*b* and the needle 31. The spring 33 axially urges the needle 31 to an opening direction away from the discharge port 36. The control valve 3 is further provided with a coil 34 that causes, when energized, magnetomotive force and the magnetomotive force allows the needle 31 to be biased to a closing direction opposite to the opening direction. The suction port 35 is constantly opened.

When the energization of the coil 34 is stopped based on the control of the ECU, the needle 31 is urged by the elastic force of the spring 33 to move away from the discharge port 36, so that the discharge port 36 is fully opened. That is, the control valve 3 is fully opened when no energization of the coil 34 is performed.

On the other hand, when the coil 34 is energized based on the control of the ECU, as shown in Fig. the energization of the coil 34 causes the magnetomotive so that the magnetomotive biases the needle 31 to the closing direction based on the current value applied in the coil 34. The control valve 3 allows the valve opening of the control valve 3 to be controlled according to the current value applied in the coil 34.

Furthermore, the fuel supply pump 1 is provided with a fuel relief path 38 branched from the part of the fuel supply path P2 that connects the discharge port 36 to the compressing chamber 23, which is referred to as fuel supply path 37. The fuel relief path 38 is disposed in substantially parallel to the lubricating path 45 and connected to pump-cam chamber 44. That is, the fuel flowing through the fuel supply path 37 passes through the fuel relief path 38 to flow into the pump-cam chamber 44. In addition, a throttle 39 is provided in the fuel relied path 38 so that it controls the flow rate of the fuel supplied to the pump-cam chamber 44 through the fuel relief path 38.

Operations of the supply pump 1 will be explained hereinafter.

In the configuration of the supply pump 1, even when excessive fuel is accumulated in the fuel supply path 37 due to the leakage of fuel from the discharge port 36 of the control valve 3 and/or the delay in the closing of the needle 31 thereof, the excessive fuel is relieved through the fuel relief path 38 into the pump-cam chamber 44. That is, in the control valve 3, after the valve opening of the needle 31 is controlled based on the control of the ECU, the fuel is leaked through the minute clearance between the needle 31 and the housing 32 so that the fuel is excessively supplied to the fuel supply path 37.

In addition, when the displacement of the needle 31 in response to the control of the ECU is delayed, the fuel is also excessively supplied to the fuel supply path 37.

In this first embodiment, however, the excessive fuel accumulated in the power supply path 37 passes through the fuel relief path 38 to be relieved into the pump-cam chamber 44. The throttle 39 allows the fuel rate flowing through the fuel relief path 38 to be controlled, making it possible to relieve only the excessive fuel into the pump-cam chamber 44.

As described above, because the fuel relief path 38 is branched from the power supply path 37 in substantially parallel to the lubricating path 45 to be connected to the pump-cam chamber 44, the fuel relief path 38 allows the excessive fuel accumulated in the power supply path 37 to be relieved into the pump-cam chamber 44 that is close to the power supply path 37.

That is, the supply pump 1 has no need to increase the fuel relief path 38 in length and to bend it at its many mid-points, making it possible to improve the workability of the fuel relief path 38.

In addition, in the fuel supply pump 1, the throttle 39 controls the fuel rate flowing through the fuel relief path 38 into the pump-cam chamber 44, preventing the fuel in the fuel supply path 37 from excessively flowing into the pump-cam chamber 44. As a result, it is possible to prevent the amount of fuel supplied to the compressing chamber 23 from decreasing.

Second Embodiment

Figure 3:
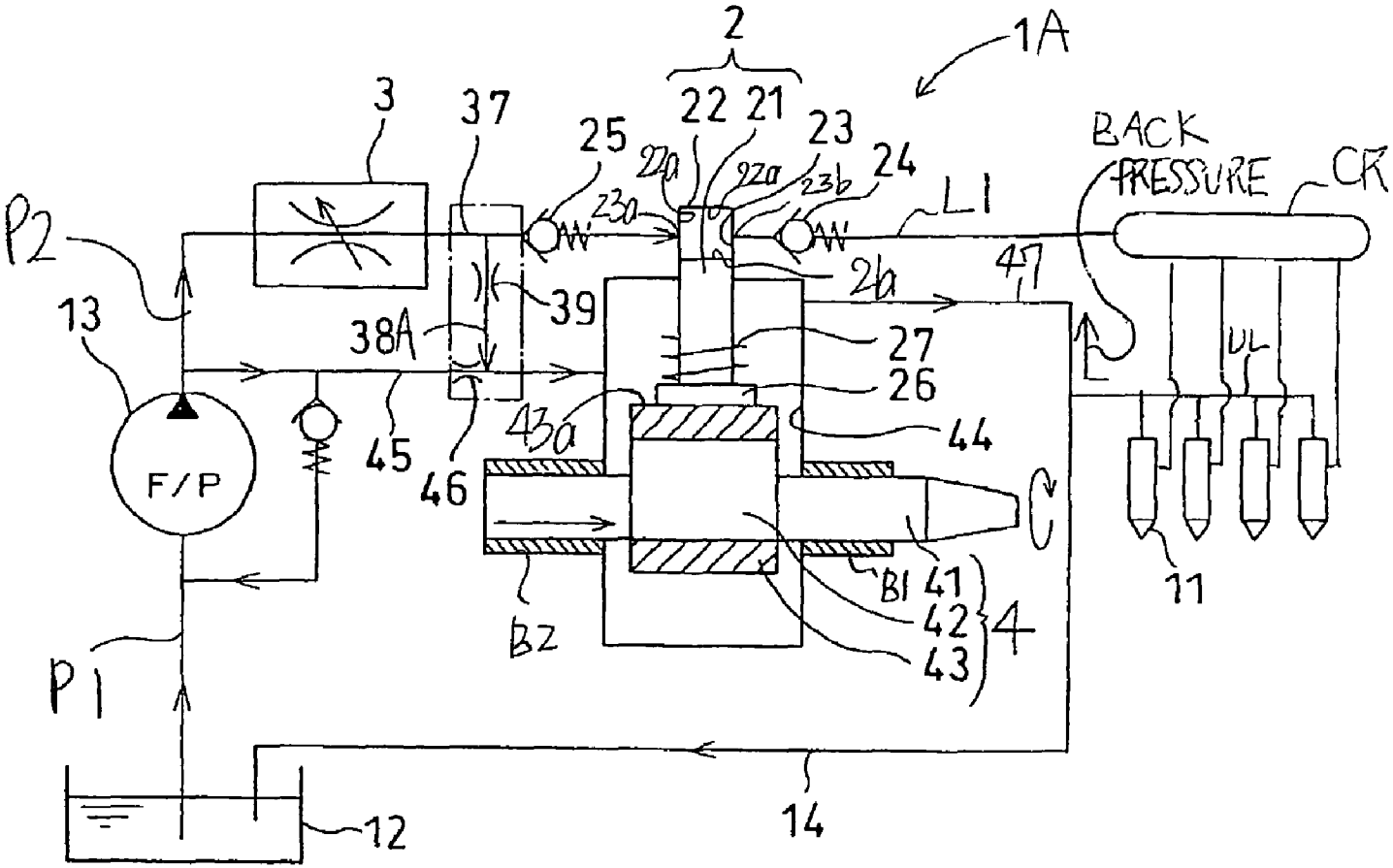
FIG. 3 is a view schematically illustrating the structure of a fuel supply pump according to a second embodiment of the present invention.
Figure 4:
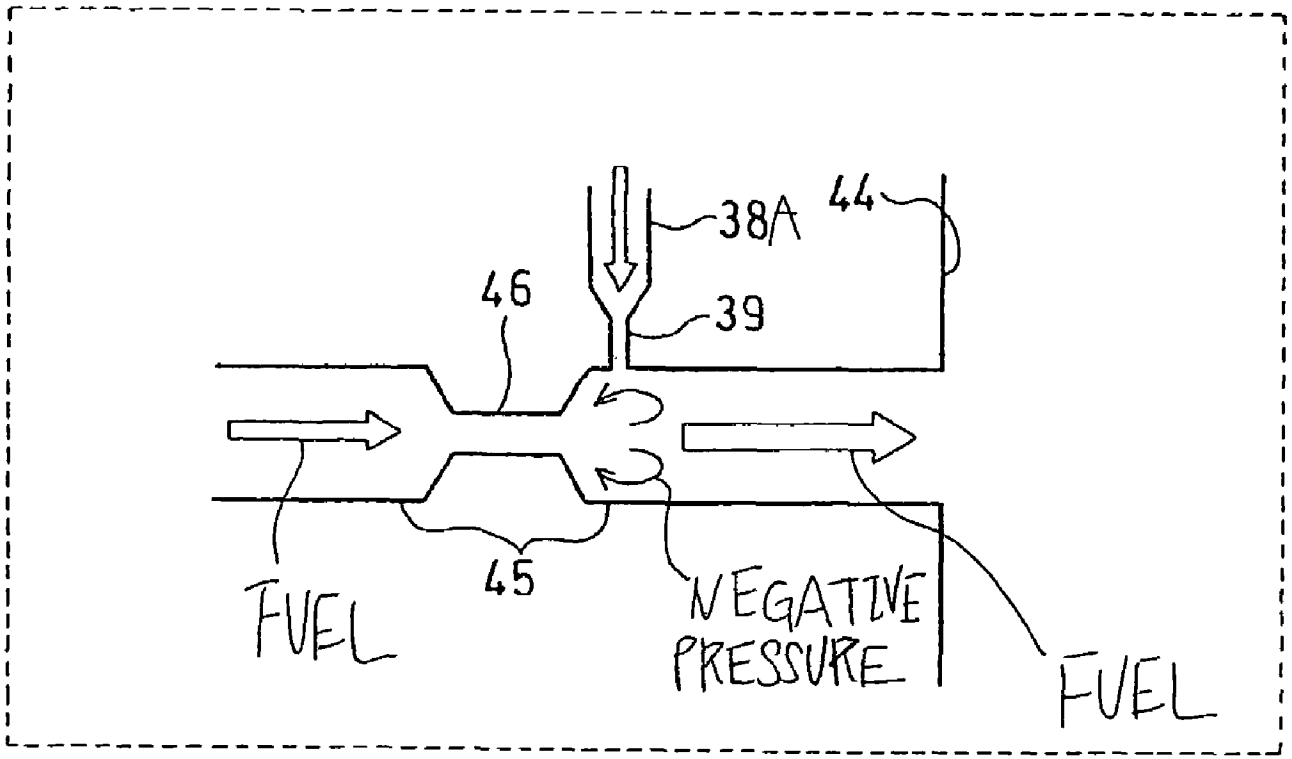
FIG. 4 is an enlarged view illustrating a lubricating path shown in FIG. 3 at its downstream side of a throttle according to the second embodiment.
Figure 5:
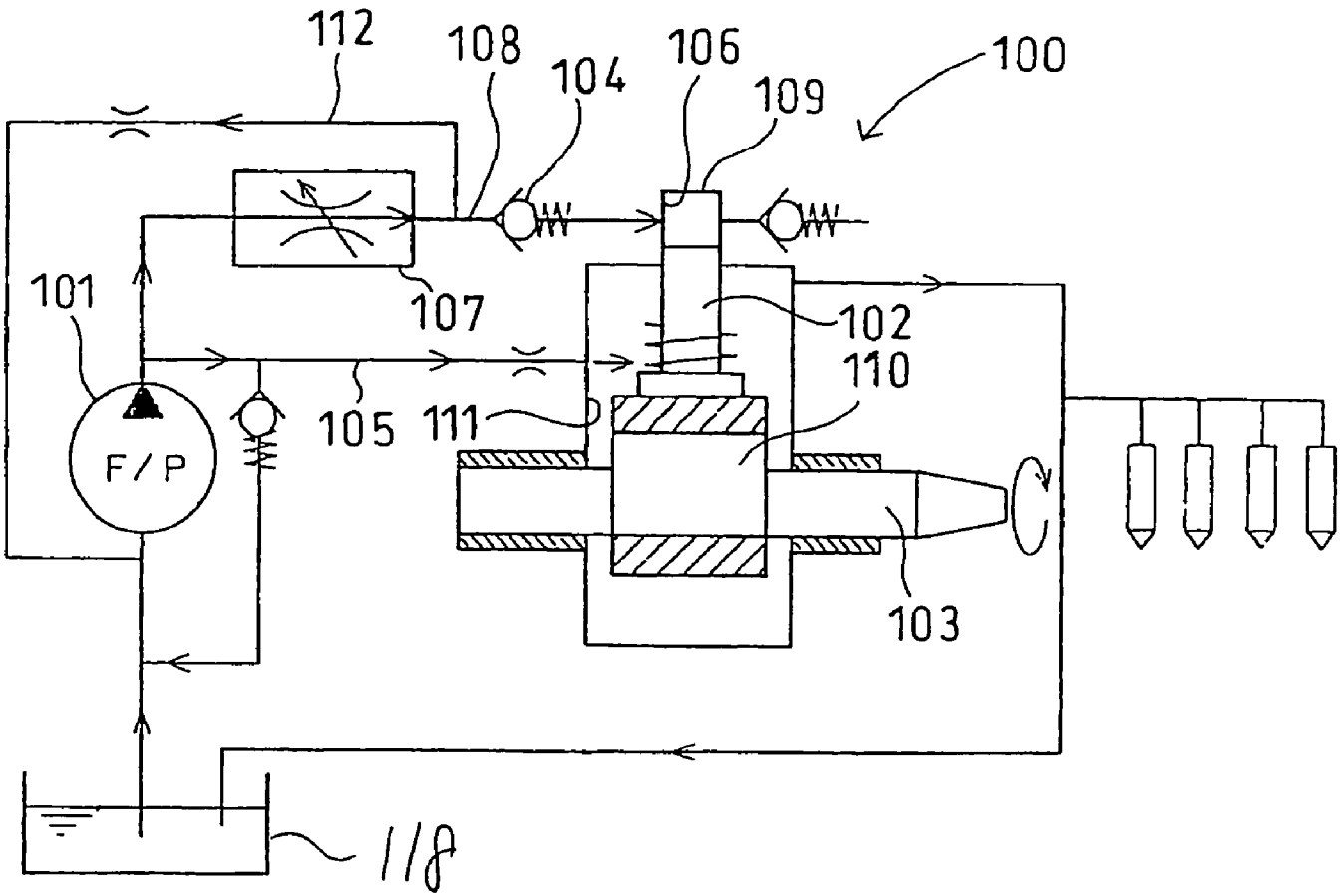
FIG. 5 is a view illustrating a conventional structure of a fuel supply pump.

As shown in FIG. 3, a supply pump 1A is provided with a fuel relief path 38A branched from the fuel supply path 37 and connected to the lubricating path 45 at its downstream side of the throttle 46. The supply pump 1A is also composed of a throttle 39 disposed in the fuel relied path 38A so that it controls the flow rate of the fuel supplied to the pump-cam chamber 44 through the fuel relief path 38A.

Other elements of the supply pump 1A according to the second embodiment, which are substantially identical with those of the supply pump 1 according to the first embodiment, are assigned to the same reference characteristics of the supply pump 1 shown in FIG. 1, and explanations thereabout are omitted or simplified.

According to the second embodiment, because the fuel relief path 38A is joined to the downstream side of the lubricating path 45 with respect to the throttle 46, negative pressure generated to the lubricating path 45 at its downstream side of the throttle 46 allows the excessive fuel in the fuel supply path 37 to be sucked through the fuel relief path 38A into the lubricating path 45. This results in that the excessive fuel is relieved through the lubricating path 45 into the pump-cam chamber 44.

In addition, the throttle 39 allows the fuel rate flowing through the fuel relief path 38A to be controlled, making it possible to suck only the excessive fuel into the pump-cam chamber 44 by the negative pressure, thereby relieving the sucked excessive fuel into the pump-cam chamber 44.

As described above, because the fuel relief path 38A is branched from the power supply path 37 and connected to the downstream side of the lubricating path 45 with respect to the throttle 46, the fuel relief path 38A permits the excessive fuel accumulated in the power supply path 37 to be relieved into the lubricating path 45 that is close to the power supply path 37.

That is, the supply pump 1A has no need to increase the fuel relief path 38A in length and to bend it at its many mid-points, making it possible to improve the workability of the fuel relief path 38A.

In addition, the fuel relief 38A is not directly connected to pump-cam chamber 44 but is connected to the downstream side of the throttle 46 so that the negative pressure allows the excessive fuel to be sucked into the lubricating path 45, which can restrain the influence of back pressure from the injectors 11.

That is, in the injectors 11, the back pressure occurs due to the returns of the excessive fuels from the injectors 11 to the fuel tank 12 through the fuel reflux path 14, so that the pressure of the lubricating fuel in the pump-cam chamber 44 is affected by the back pressure through the overflow path 47.

The discharge pressure of the feed pump 13 at the upstream side of the throttle 46 is far larger than the back pressure from the injectors 11. This results in that the lubricating fuel constantly flows in the lubricating path 45 from the feed pump 13 to the pump-cam chamber 44 so that the negative pressure is constantly caused at the downstream side of the throttle 46. The negative pressure, therefore, allows the excessive fuel in the fuel supply path 37 to be sucked into the lubricating path 45 while it substantially frees of influence from the back pressure.

In addition, in the fuel supply pump 1A, the throttle 39 controls the fuel rate flowing through the fuel relief path 38A into the pump-cam chamber 44, preventing the fuel in the fuel supply path 37 from excessively flowing into the pump-cam chamber 44. As a result, it is possible to prevent the amount of fuel supplied to the compressing chamber 23 from decreasing.

Incidentally, in the first and second embodiments, the supply pumps 1 and 1A are applied to the common-rail fuel injection system, but the present invention is not limited to the application. That is, the supply pumps 1 and 1A may be applied to a jerk fuel injection system that directly supplies the high-pressurized fuel supplied from the supply pump 1, 1A to each cylinder of the internal combustion engine through the injectors 11.

In addition, in each of the first and second embodiments, the throttle 39, 39A is provided in the fuel relief path 38, 38A, but the throttle 39, 39A may be not necessarily provided in the fuel relief path 38, 38A.

Moreover, as the throttles 39 (39A) and 46, orifices, chokes or other similar members may be used.

While there has been described what is at present considered to be the embodiments and modifications of the invention, it will be understood that various modifications which are not described yet may be made therein, and it is intended to cover in the appended claims all such modifications as fall within the true spirit and scope of the invention.

This application is based upon and claims the benefit of priority of the prior Japanese Patent Application 2003-100851 filed on Apr. 3, 2003, and the prior Japanese Patent Application 2004-37839 filed on Feb. 16, 2004, so that the contents of which are incorporated herein by reference.

What is claimed is:

1. A fuel supply pump for pressurizing a fuel fed from a low-pressure feed pump, said fuel supply pump comprising:

a pump element having a plunger and a compressing chamber, said compressing chamber being connected through a fuel supply path to the low-pressure feed pump, said fuel fed from the low-pressure feed pump being supplied to the compressing chamber through the fuel supply path, said plunger pressurizing the fuel supplied to the compressing chamber;

a plunger driving unit having a driving member and a housing for reciprocating said plunger, said driving member being rotatably supported to the housing and slidably contacted to the plunger;

a control member provided in the fuel supply path to control a fuel rate of the fuel fed from the low-pressure pump through the fuel supply path;

a check valve provided in a part of the fuel supply path, said part of the fuel supply path being connected between the control member and the compressing chamber, said check valve preventing the fuel supplied to the compressing chamber from flowing backward to the control member;

lubricating means for supplying a part of fuel to a slidably contact portion between the plunger and the plunger driving unit, said part of fuel being fed from the low-pressure feed pump through the fuel supply path;

first throttle means provided in the lubricating means for controlling the part of fuel supplied through the lubricating means; and fuel relief means for relieving a part of fuel into a downstream side of the lubricating means with respect to the first throttle means, said part of fuel being supplied through the fuel supply means to the compressing chamber.

2. A fuel supply pump according to claim 1, wherein said fuel relief means is provided with second throttle means.

* * * * *